US011069310B2

(12) United States Patent
Matsui

(10) Patent No.: US 11,069,310 B2
(45) Date of Patent: Jul. 20, 2021

(54) IMAGE DISPLAY APPARATUS AND IMAGE DISPLAY METHOD

(71) Applicant: NEC Display Solutions, Ltd., Tokyo (JP)

(72) Inventor: Katsuyuki Matsui, Tokyo (JP)

(73) Assignee: SHARP NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 16/766,153

(22) PCT Filed: Dec. 13, 2017

(86) PCT No.: PCT/JP2017/044733
§ 371 (c)(1),
(2) Date: May 21, 2020

(87) PCT Pub. No.: WO2019/116463
PCT Pub. Date: Jun. 20, 2019

(65) Prior Publication Data

US 2020/0365100 A1 Nov. 19, 2020

(51) Int. Cl.
*G09G 3/36* (2006.01)

(52) U.S. Cl.
CPC ... *G09G 3/3607* (2013.01); *G09G 2320/0233* (2013.01); *G09G 2320/0242* (2013.01); *G09G 2320/0666* (2013.01)

(58) Field of Classification Search
CPC ..... G02F 1/133; G03B 21/00; G03B 21/14; G09G 5/00; G09G 5/02; G09G 5/36; G09G 3/20; G09G 3/3607; G09G 2320/0233; G09G 2320/0242; G09G 2320/0666; H04N 5/74
See application file for complete search history.

(56) References Cited

U.S. PATENT DOCUMENTS 9,343,024 B2 * 5/2016 Lee ..... G09G 5/10
2004/0196303 A1 * 10/2004 Matsuda ..... H04N 9/3182 345/690
2018/0144698 A1 * 5/2018 Park ..... G09G 3/3677

FOREIGN PATENT DOCUMENTS

JP 2004-228948 A 8/2004
JP 2004-288750 A 10/2004
JP 2014-071444 A 4/2014
JP 2017-129704 A 7/2017

OTHER PUBLICATIONS

International Search Report (ISR) (PCT Form PCT/ISA/210), in PCT/JP2017/044733, dated Jan. 23, 2018.

* cited by examiner

*Primary Examiner* — Nelson M Rosario
(74) *Attorney, Agent, or Firm* — McGinn I.P. Law Group, PLLC.

(57) ABSTRACT

The present invention is provided with a correction data generation unit that generates third correction data that is used for correcting display unevenness of the image display apparatus on the basis of first correction data that is used for correcting display unevenness resulting from the image display apparatus itself and second correction data that is used for correcting display unevenness resulting from an environment set for the image display apparatus, and a correction unit that corrects an image signal using the third correction data.

9 Claims, 10 Drawing Sheets

(a)

(b)

(a)

(b)

(a)

(b)

IMAGE DISPLAY APPARATUS AND IMAGE DISPLAY METHOD

TECHNICAL FIELD

The present invention relates to an image display apparatus, such as a liquid crystal monitor, and an image display method.

BACKGROUND ART

In industries such as medical care, printing, and advertisement, numerically accurate color reproduction is required for image display apparatuses (displays) because these apparatuses are used for diagnosis and expression of colors. For this reason, there is a demand for accuracy in luminance and chromaticity of images displayed as display images in image display apparatuses, and there is a demand for improvement of non-uniformity (display unevenness) in luminance of display images in image display apparatuses. Patent Document 1 discloses a technology that reduces variations in electrical characteristics of thin film transistors that are provided in a liquid crystal panel to reduce display unevenness.

PRIOR ART DOCUMENT

Patent Document

Patent Document 1: Japanese Unexamined Patent Application, First Publication No. 2004-288750

SUMMARY OF THE INVENTION

Problems to be Solved by Invention

However, the factors that cause display unevenness are roughly classified into those that depend on an apparatus (e.g., the display characteristics of a liquid crystal panel) and those that depend on an environment (e.g., the relative positional relationship between a display image of an image display apparatus and the viewpoint of a user). The technology disclosed in Patent Document 1 can correct only display unevenness resulting from an apparatus.

In view of the above problem, an example object of the present invention is to provide an image display apparatus and an image display method that are capable of correcting not only display unevenness resulting from an image display apparatus but also display unevenness resulting from an environment.

Means for Solving the Problems

The present invention is an image display apparatus that includes: a correction data generation unit that generates third correction data that is used for correcting display unevenness of the image display apparatus on the basis of first correction data that is used for correcting display unevenness resulting from the image display apparatus itself and second correction data that is used for correcting display unevenness resulting from an environment set for the image display apparatus; and a correction unit that corrects an image signal using the third correction data.

Example Advantages of the Invention

As described above, the present invention can correct not only display unevenness resulting from an image display apparatus but also display unevenness resulting from an environment.

MODES FOR CARRYING OUT THE INVENTION

Hereinafter, image display apparatuses and image display methods in accordance with example embodiments of the present invention will be described with reference to the drawings.

First Example Embodiment

First, a first example embodiment will be described.

Figure 1:
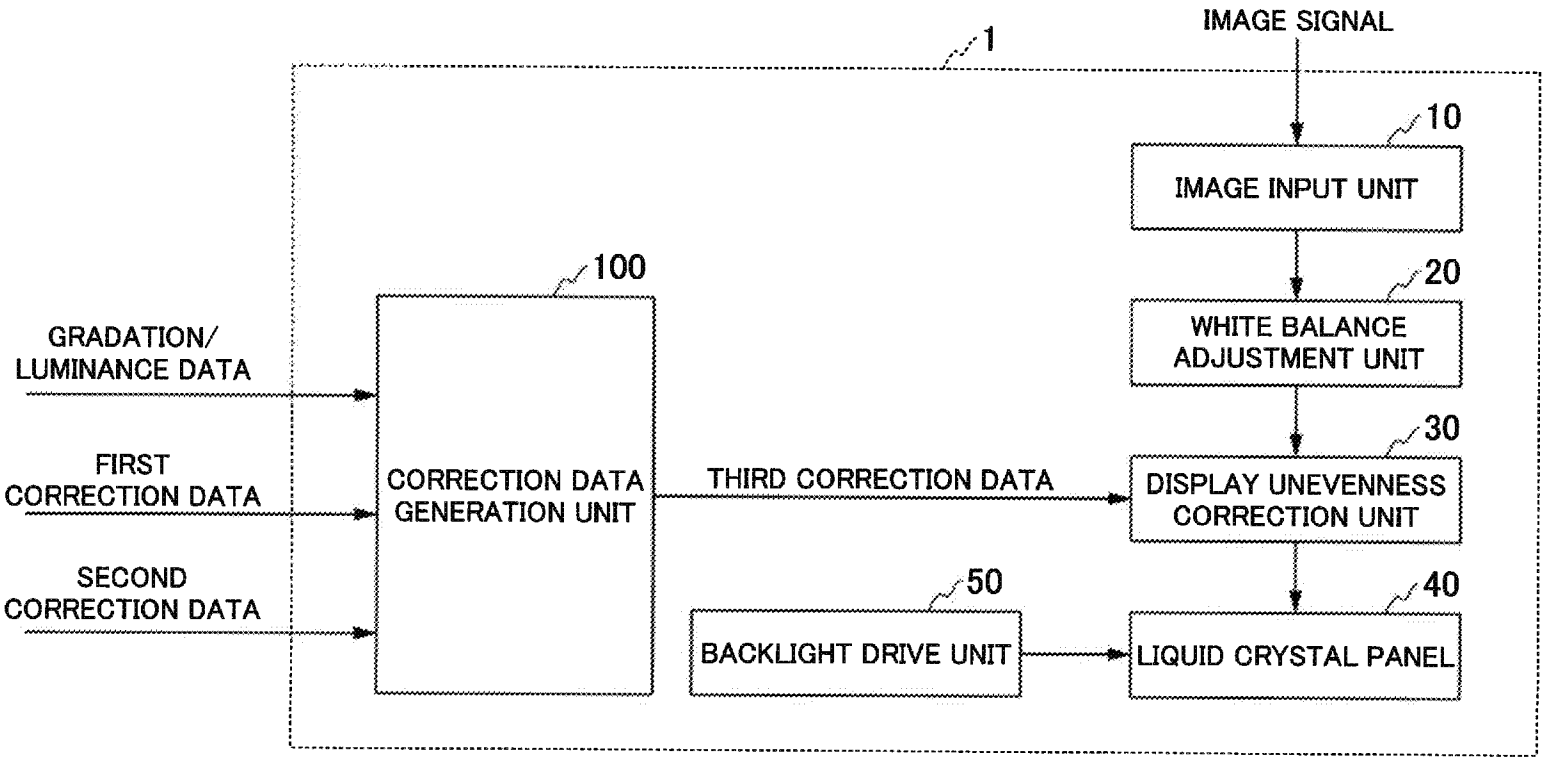
FIG. 1 is a block diagram showing an example of the structure of an image display apparatus 1 in accordance with a first example embodiment.

FIG. 1 is a block diagram showing an example of the structure of an image display apparatus 1 in accordance with the first example embodiment. As shown in FIG. 1, the image display apparatus 1 is provided with an image input unit 10, a white balance adjustment unit 20, a display unevenness correction unit 30, a liquid crystal panel 40, a backlight drive unit 50, and a correction data generation unit 100. Here, the display unevenness correction unit 30 is an example of "a correction unit". Moreover, the correction data generation unit 100 is an example of "a correction data generation unit".

The image display apparatus 1 is a display apparatus that displays an image based on an input image signal. The image display apparatus 1 corrects the image signal using correction data generated by the correction data generation unit 100. Accordingly, the image display apparatus 1 suppresses display unevenness that is generated when the image based on the image signal is displayed.

The image signal is input from the outside (e.g., an external apparatus that generates the image signal) to the image input unit 10. The image input unit 10 outputs the input image signal to the white balance adjustment unit 20.

The white balance adjustment unit 20 acquires the image signal from the image input unit 10 and converts the proportions of the colors in the acquired image signal so as to generate a color that corresponds to a hue set by, for example, a user, such as a warm color or a cold color. For example, with respect to a pixel for which RGB (red, green, and blue) values of (255, 255, 255) (i.e., white) are specified, the white balance adjustment unit 20 performs conversion on the proportions of the RGB colors so as to convert these RGB values into RGB values of (255, 200, 120), thereby changing the color of the pixel to a warm color in which a blue component is reduced. The white balance adjustment unit 20 outputs an image signal in which the proportions of the RGB colors has been converted to the display unevenness correction unit 30.

The display unevenness correction unit 30 acquires the image signal from the white balance adjustment unit 20. Moreover, third correction data output from the correction data generation unit 100 is input to the display unevenness correction unit 30.

The display unevenness correction unit 30 corrects the image signal from the white balance adjustment unit 20 on the basis of the third correction data. The display unevenness correction unit 30 corrects the image signal by, for example, adding, to pixels at predetermined positions in the image based on the image signal, correction values that correspond to these positions in the third correction data. The display unevenness correction unit 30 outputs the corrected image signal to the liquid crystal panel 40.

The image signal is input from the display unevenness correction unit 30 to the liquid crystal panel 40. By inputting the image signal to the liquid crystal panel 40, the state of polarization in accordance with the image signal is formed in the liquid crystal panel 40. Moreover, a backlight is irradiated to the liquid crystal panel 40, and thus an image that corresponds to the image signal is displayed in the liquid crystal panel 40. The backlight drive unit 50 drives the backlight, which irradiates the liquid crystal panel 40, in accordance with an instruction from a display control unit (not shown in the drawings) of the image display apparatus 1.

The correction data generation unit 100 generates the correction data (the third correction data), which is used by the display unevenness correction unit 30 for correction of an image. Gradation/luminance data, first correction data, and second correction data are input to the correction data generation unit 100. The gradation/luminance data, the first correction data, and the second correction data may be stored in a storage unit (not shown in the drawings) of the image display apparatus 1 in advance, or they may be input by an operation of, for example, the user via an input unit (not shown in the drawings) of the image display apparatus 1.

The gradation/luminance data is data that indicates the correspondence relationship between the gradation of an image signal and the luminance of an image based on the image signal when the image is displayed.

In the following description, the first correction data, the second correction data, and the third correction data are simply referred to as "correction data" when the first correction data, the second correction data, and the third correction data are not discriminated from one another. The correction data is data that associates a position in an image with a correction value for a pixel at the position. A correction value is represented as, for example, the proportions of the RGB colors of a pixel that are used for conversion, or an offset value. Moreover, a correction value may be specified for each of the combinations of colors (e.g., the RGB colors) and gradations (e.g., a 255 gradation, a 192 gradation, a 128 gradation, a 64 gradation, and a 0 gradation). Furthermore, a correction value may be represented as a gradation, such as RGB values in an image signal, or it may be represented as luminance of a display image when the image is displayed. Additionally, a correction value may be represented as an absolute value, or it may be represented as, for example, a relative value or a ratio (e.g., a percentage).

Moreover, the following description describes an example in which the first correction data and the third correction data are data used for correcting a gradation and the second correction data is data used for correcting luminance. However, the first correction data, the second correction data, and the third correction are not limited to such data. Both the first correction data and the second correction data may be data used for correcting a gradation, and both the first correction data and the second correction data may be data used for correcting luminance. Moreover, the first correction data may be data used for correcting luminance and the second correction data may be data used for correcting a gradation. Furthermore, the third correction data may be data used for correcting luminance.

Figure 2:
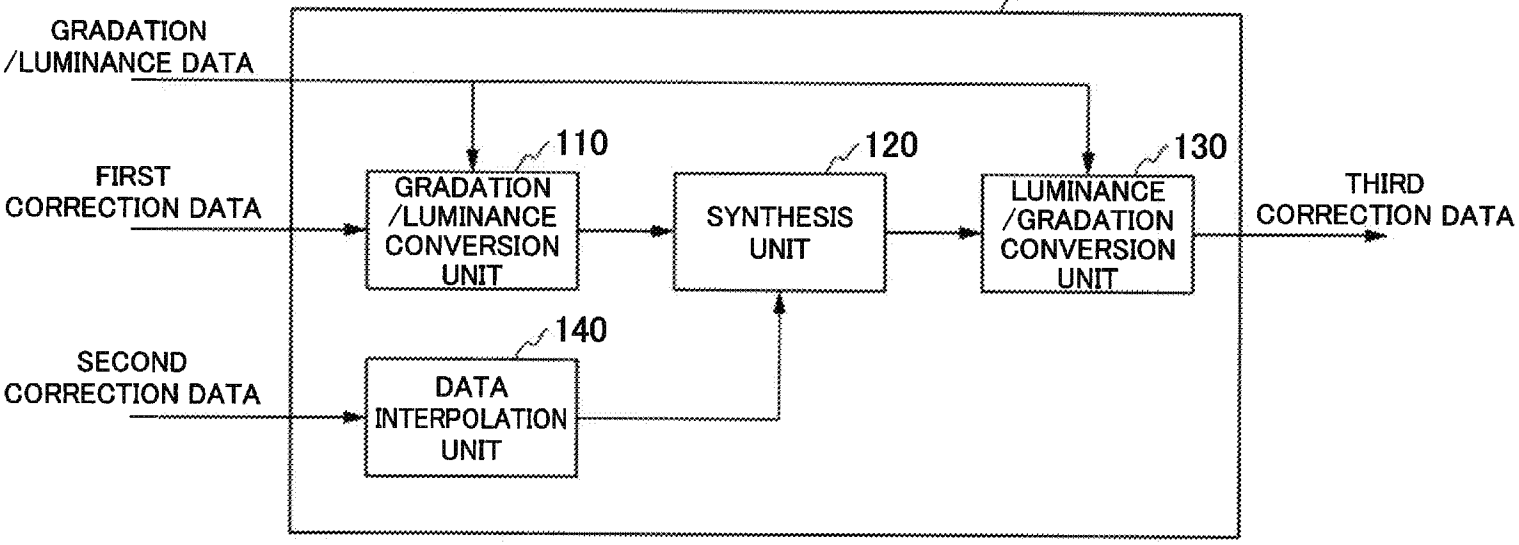
FIG. 2 is a block diagram showing an example of the structure of a correction data generation unit 100 in accordance with the first example embodiment.

FIG. 2 is a block diagram showing an example of the structure of the correction data generation unit 100 in accordance with the first example embodiment.

The correction data generation unit 100 is provided with, for example, a gradation/luminance conversion unit 110, a synthesis unit 120, a luminance/gradation conversion unit 130, and a data interpolation unit 140. Here, the gradation/luminance conversion unit 110 is an example of "a first conversion unit". Moreover, the luminance/gradation conversion unit 130 is an example of "a second conversion unit".

The gradation/luminance conversion unit 110 converts data represented as a gradation into data represented as luminance. The first correction data represented as a gradation is input to the gradation/luminance conversion unit 110. Moreover, gradation/luminance data is input to the gradation/luminance conversion unit 110.

The gradation/luminance conversion unit 110 converts the first correction data into data represented as luminance using the gradation/luminance data. The gradation/luminance conversion unit 110 outputs the converted first correction data to the synthesis unit 120.

The synthesis unit 120 synthesizes two pieces of input data. Data from the gradation/luminance conversion unit 110 and data from the data interpolation unit 140 are input to the synthesis unit 120. The synthesis unit 120 synthesizes the input data and outputs the synthesized data to the luminance/gradation conversion unit 130.

The luminance/gradation conversion unit 130 converts data represented as luminance into data represented as a gradation. The data represented as luminance is input from the synthesis unit 120 to the luminance/gradation conversion unit 130. Moreover, the gradation/luminance data is input to the luminance/gradation conversion unit 130. The luminance/gradation conversion unit 130 converts the data from the synthesis unit 120 into the data represented as a gradation using the gradation/luminance data. The luminance/ gradation conversion unit 130 outputs the converted data to the display unevenness correction unit 30 as the third correction data.

The data interpolation unit 140 interpolates input data. The second correction data is input to the data interpolation unit 140. The data interpolation unit 140 interpolates the input second correction data and outputs the interpolated second correction data to the synthesis unit 120.

Figure 3:
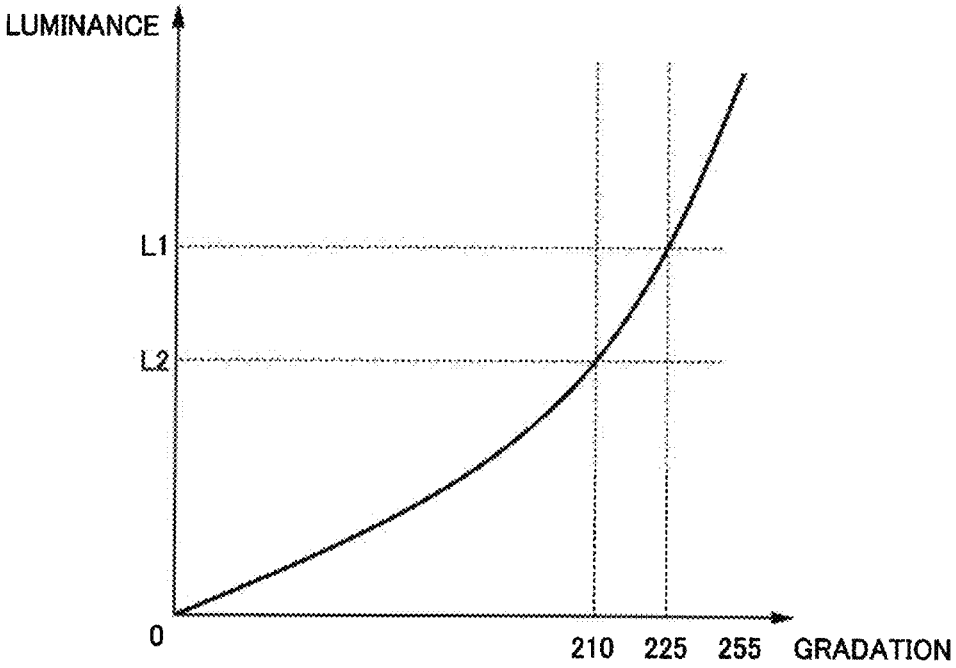
FIG. 3 is a diagram showing an example of gradation/luminance data in accordance with the first example embodiment.

FIG. 3 is a diagram showing an example of the gradation/luminance data of the first example embodiment. The horizontal axis of FIG. 3 represents a gradation of an image signal and the vertical axis of FIG. 3 represents luminance.

As shown in FIG. 3, the gradation/luminance data indicates the correspondence relationship between the gradation of an image signal at a specific position in an image and luminance when the image signal is displayed. In the example of FIG. 3, a gradation of 225 corresponds to luminance of L1 and a gradation of 210 corresponds to luminance of L2.

Figure 4:
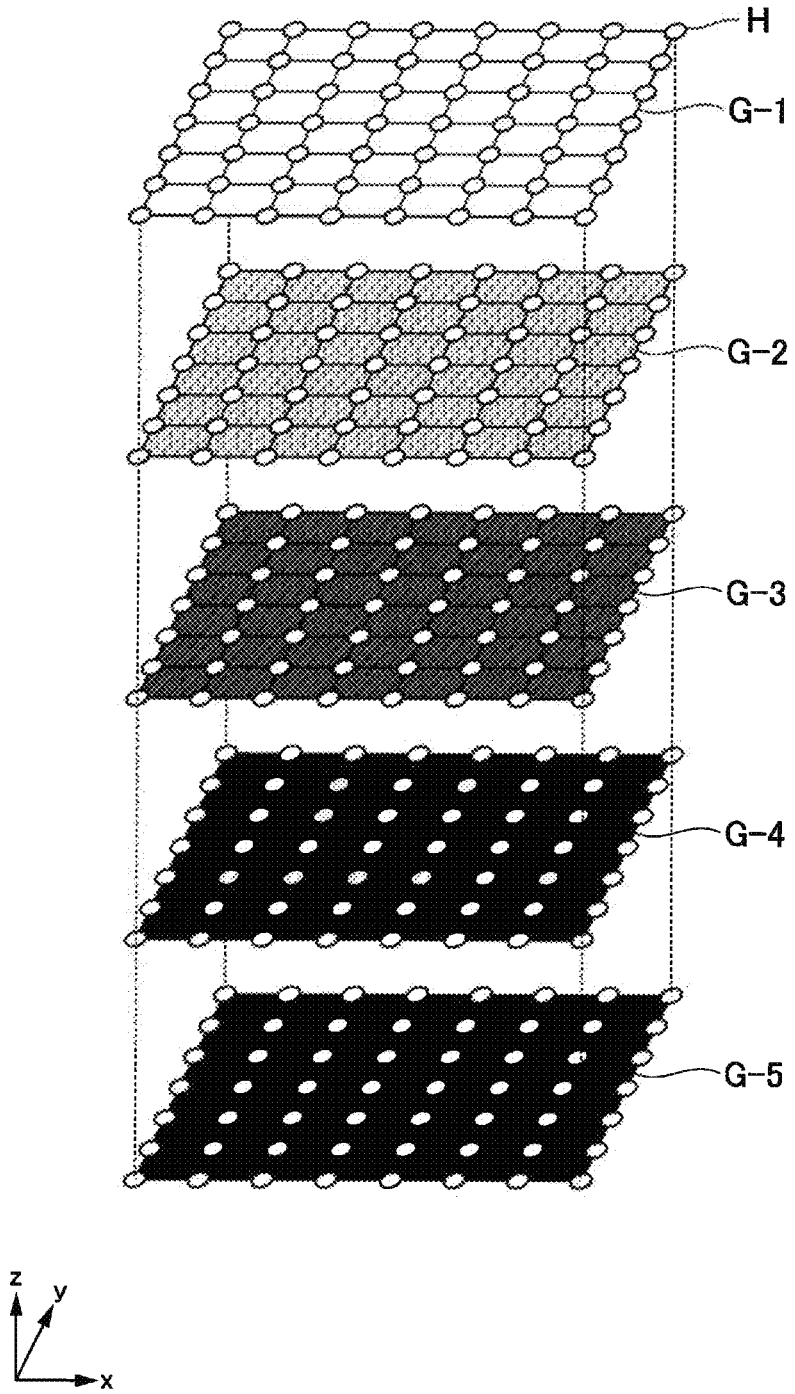
FIG. 4 is a diagram describing first correction data of the first example embodiment.

FIG. 4 is a diagram describing the first correction data of the first example embodiment.

The first correction data is data that indicates the correspondence relationship between the positions in an image and correction values used for correcting the pixels at the positions. The first correction data is generated, for example, for each of a plurality of correction layers. The correction layers are, for example, images classified on the basis of the RGB values in an image signal, and they are, for example, images G (G-1 to G-5) that correspond to a gradation of 255, a gradation of 192, a gradation of 128, and a gradation of 64, as shown in FIG. 4. In the example of FIG. 4, the RGB values of the image G-1 are (255, 255, 255), the RGB values of the image G-2 are (192, 192, 192), the RGB values of the image G-3 are (128, 128, 128), the RGB values of the image G-4 are (64, 64, 64), and the RGB values of the image G-5 are (0, 0, 0).

Moreover, the first correction data is data used for correcting display unevenness resulting from the image display apparatus itself. The first correction data represents, for example, a correction value for a correction point H represented by a hollow circle in FIG. 4. A plurality of correction points H may be provided in an image G. For example, 40 correction points H are provided in an x-axis direction, which is the horizontal direction, of the image G, and 20 correction points H are provided in a y-axis direction, which is the vertical direction, of the image G. In this case, correction values are generated for the combinations of the correction points H, the RGB colors, and the gradations, and thus the first correction data includes a great number of correction values, that is, 40 in horizontal direction×20 in vertical direction×three RGB colors×layers corresponding to five gradations.

The first correction data is, for example, correction data that is generated in the course of production or shipping inspection in a factory. For example, the first correction data is data that is generated using dedicated machinery and materials under special circumstances in a factory, such as a situation in which the entire display image is captured using a high-performance camera that is capable of capturing images with uniform quality in a darkroom, which blocks natural light irradiated from the surroundings and light from fluorescent lamps. Moreover, the first correction data may be, for example, correction data when the white balance setting of the image display apparatus 1 is invalidated.

Figure 5:
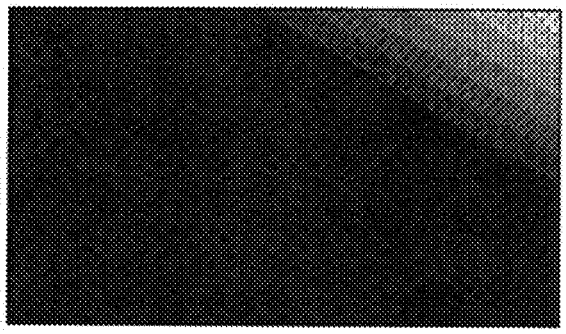
FIG. 5 is a diagram describing second correction data of the first example embodiment.
Figure 5:
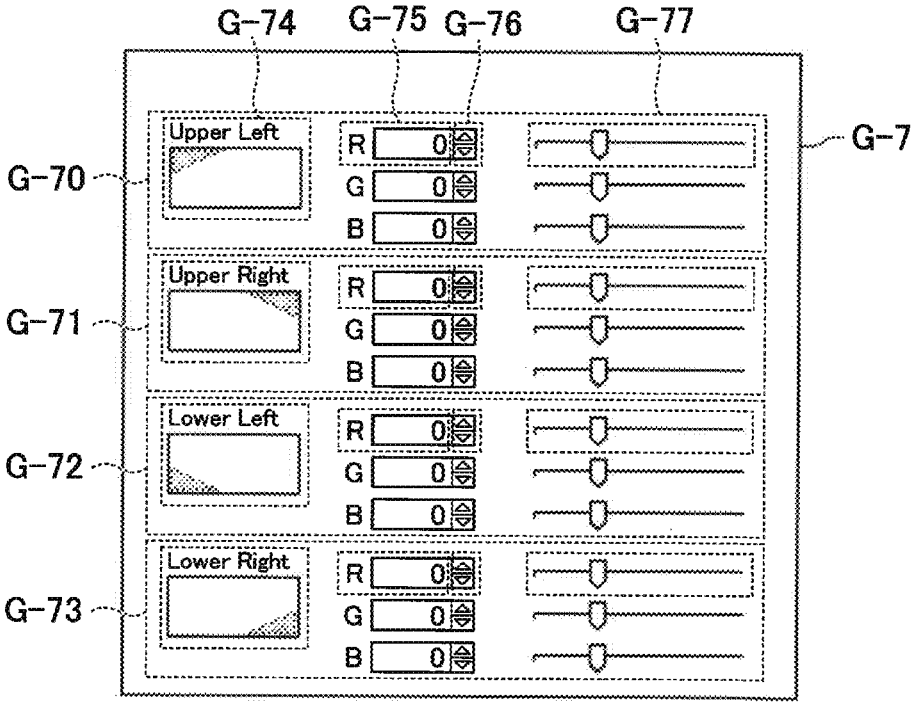

FIG. 5 is a diagram describing the second correction data of the first example embodiment. FIG. 5(*a*) is an example when an image in which display unevenness has been corrected using the first correction data is displayed. FIG. 5(*b*) is an example of an image that is used for setting the second correction data.

An image G-6 shown in FIG. 5(*a*) is an example of an image obtained by adjusting the white balance of an image based on an image signal in which the values of RGB are the same (i.e., an image having a single color) in the white balance adjustment unit 20, correcting display unevenness of the image signal using the first correction data in the display unevenness correction unit 30, and displaying the image signal on the liquid crystal panel 40. The image G-6 is a color image, and it is an image in which the hue of green in the upper right portion slightly separated from the central portion is strongly displayed, the central portion is dark, and the inner portion of the display image is brighter than the peripheral portion thereof. That is, display unevenness is generated in the image G-6, despite the display unevenness has been corrected using the first correction data.

As described above, the first correction data is generated with the white balance invalidated. In contrast, when the white balance is validated, the white balance adjustment unit 20 converts white in which the values of RGB are the same, that is, (255, 255, 255), in an image signal into white in which the values of RGB are different from one another, for example, (255, 200, 120).

The image signal of which white balance has been adjusted by the white balance adjustment unit 20 is input to the display unevenness correction unit 30. That is, white in which the values of RGB are different from one another, which has been converted from white in which the values of RGB are the same, is input. The display unevenness correction unit 30 performs correction on white in which the values of RGB are different from one another using the plurality of correction layers. For example, the display unevenness correction unit 30 corrects R(255) in RGB values (255, 200, 120) using the correction values of the correction layer for a gradation of 255 Moreover, the display unevenness correction unit 30 calculates correction values for G(200) by performing, for example, linear interpolation using the correction values of the correction layer for a gradation of 255 and correction values of the correction layer for a gradation of 192 and performs correction using the calculated correction values. Furthermore, the display unevenness correction unit 30 calculates correction values for B(120) by performing, for example, linear interpolation using correction values of the correction layer for a gradation of 128 and correction values of the correction layer for a gradation of 64 and performs correction using the calculated correction values.

The correction values indicated in each of the correction layers are generated for each of the gradations so that display unevenness becomes inconspicuous over the entirety of a display message. For this reason, if correction is performed using a different correction layer, the balance over the entirety of a display image is broken and thus display unevenness may be generated.

It is conceivable that the display unevenness generated in the image G-6 shown in FIG. 5(*a*) is caused by the difference between the environment in which the first correction data was generated and the environment in which an image is displayed. Here, the environment in which an image is displayed includes the state of an environment in a place where the image display apparatus 1 is installed and natural light or the like is irradiated, the relative positional relationship between a display image of the image display apparatus 1 and the line of sight of a user, a white balance setting used by a user, and secular change.

The present example embodiment corrects display unevenness generated by such a difference between the environments. Specifically, display unevenness caused by such a difference between the environments is corrected using the second correction data generated by, for example, a user who visually perceives an image displayed in an actual environment in which the image display apparatus 1 is used by the user.

The second correction data is data that is used for correcting display unevenness resulting from the environment set for the image display apparatus. The second correction data is correction data that is generated in an environment in which a user uses the image display apparatus 1. For example, the second correction data is data that is used for correcting display unevenness recognized by the eyes of a user when the user views the image display apparatus 1 from the position where the user should visually perceive the image display apparatus 1 while light such as natural light is irradiated from the surroundings to the image display apparatus 1. Moreover, the second correction data may be, for example, correction data when the white balance setting of the image display apparatus 1 is validated.

For example, the second correction data is generated by, for example, a user who operates an image G-7 shown in FIG. 5(*b*). The image G-7 includes, for example, a plurality of images G-70 to G-73 that are used for setting correction values for the positions where correction is performed. In the example of FIG. 5(*b*), the image G-70, the image G-71, the image G-70, and the image G-70 are images that are used for setting correction values for an upper left region, correction values for an upper right region, correction values for a lower left region, and correction values for a lower right region, respectively. The following description describes an example in which correction points in the respective regions (upper left, upper right, lower left, and lower right) are four pixels that are located at the four corners of the entire image. However, the correction points are not limited to such pixels. A correction point may be a pixel located at the center of a group of pixels in each region, a pixel located at a position that is different from the center, or a pixel located at any position in each region.

Each of the images G-70 to G-73 is configured by an image G-74 that indicates the position where correction is to be performed, images G-75 that indicate correction values for the RGB colors, and images G-76 and images G-77 that are used for setting or changing the correction values.

For example, a user selects, from among the images G-70 to G-73, an image corresponding to a position where the user has recognized that display unevenness is generated, using an input apparatus (not shown in the drawings), such as a mouse, that is used for inputting information to the image display apparatus 1, and sets correction values for the RGB values at that position. For example, when the user has recognized that the hue of green in the upper right portion of the image G-6 slightly separated from the center portion thereof is strongly displayed, the user sets a correction value with which the luminance of G among the RGB values of the image G-71 is decreased. FIG. 5(*b*) shows an example of a correction value with which the luminance of G among the RGB values of the image G-71 is decreased by −5[%]. In this way, a correction value in the second correction data may be represented as a ratio [%] to the maximum value of luminance in the image display apparatus. Moreover, a correction value in the second correction data may be represented as an absolute value [cd/m$^2$].

When a correction value is to be set finely (e.g., in units of 1[%]), for example, a user decreases or increases the correction value step by step by clicking a downward triangular mark or upward triangular mark of an image G-76. Moreover, when a correction value is to be set roughly (e.g., in units of 10[%]), for example, a user moves a slider mark in an image G-77 along a slide bar. Alternatively, for example, a user may directly input a correction value to an image G-75 using, for example, a keyboard.

The correction data generation unit 100 acquires correction values set by an operation of, for example, the user in this manner as the second correction data. The following description describes a method in which the data interpolation unit 140 of the correction data generation unit 100 interpolates the second correction data with reference to FIG. 6.

Figure 6:
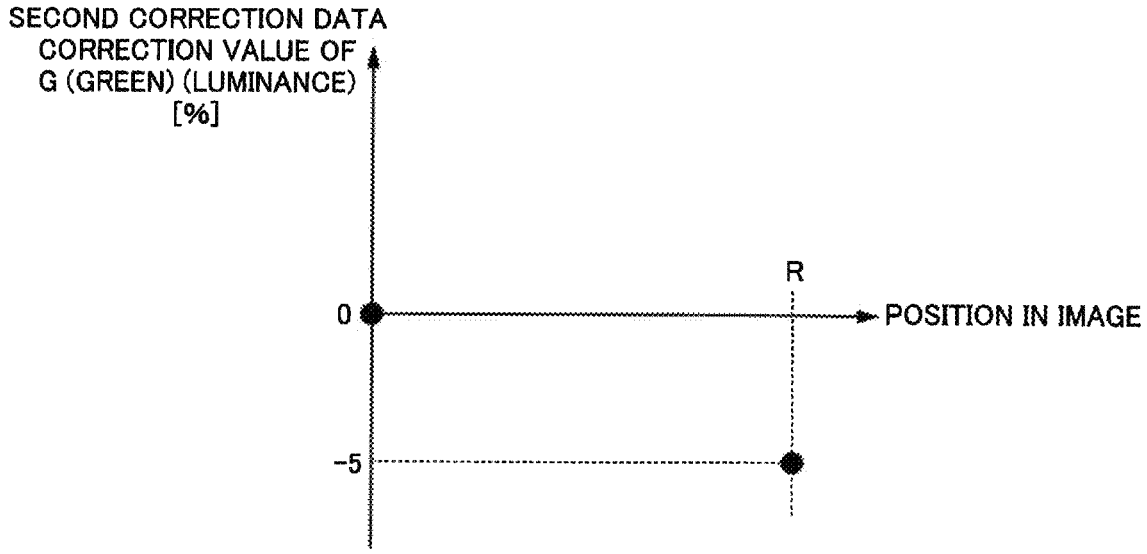
FIG. 6 is a diagram describing a process of interpolating the second correction data in accordance with the first example embodiment.
Figure 6:
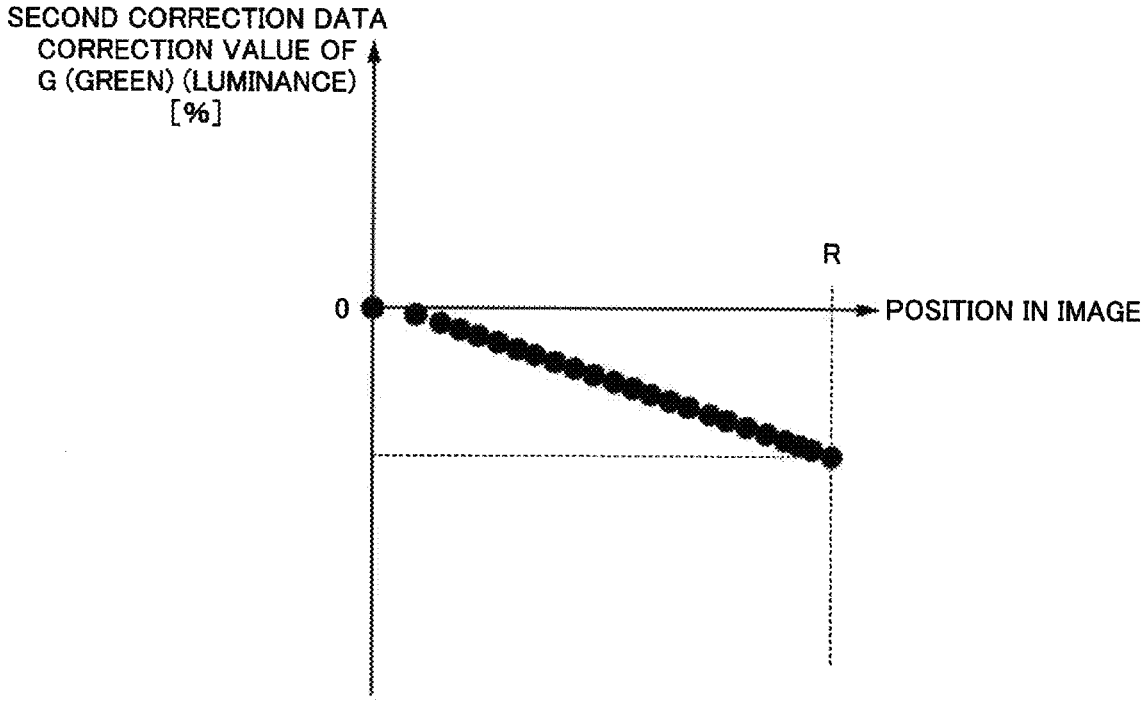

FIG. 6 is a diagram describing a process in which the correction data generation unit 100 in accordance with the first example embodiment interpolates the second correction data. FIG. 6(*a*) shows an example of the second correction data before interpolation is performed. FIG. 6(*b*) shows an example of the interpolated second correction data. In each of FIG. 6(*a*) and FIG. 6(*b*), the horizontal axis represents a position in an image and the vertical axis represents a correction value for G (green) in the second correction data. Moreover, "0" in the horizontal axis corresponds to the position of the upper left edge of an image and "R" corresponds to the position of the upper right edge of the image. Furthermore, the vertical axis represents the second correction data as a ratio [%] to the maximum value of luminance.

When the data interpolation unit 140 acquires second correction data indicating that a correction value for a correction point located at the upper left of an image is 0[%] and a correction value for a correction point located at the upper right of the image is −5[%] as shown in FIG. 6(*a*), the data interpolation unit 140 linearly interpolates the correction values for the two correction points to derive correction values for correction points between the two correction points as shown in FIG. 6(*b*).

Here, the correction points between the two correction points are, for example, correction points that correspond to the first correction data. For example, when 40 pieces of the first correction data and two correction points (e.g., a correction point located at an upper right edge and a correction point located at an upper left edge) of the second correction data are provided in an x-axis direction, which is the horizontal direction of an image, the data interpolation unit 140 linearly interpolates the correction values at the two correction points of the second correction data to derive correction values for 38 correction points located between the two correction points.

Although the example of FIG. 6 describes an example when the data interpolation unit 140 interpolates data from the upper left of a screen to the upper right of the screen, data to be interpolated is not limited to such data. The data interpolation unit 140 may interpolate respective pieces of data from the lower left of the screen to the upper right of the screen and respective pieces of data from the lower right of the screen to the upper right of the screen.

Figure 7:
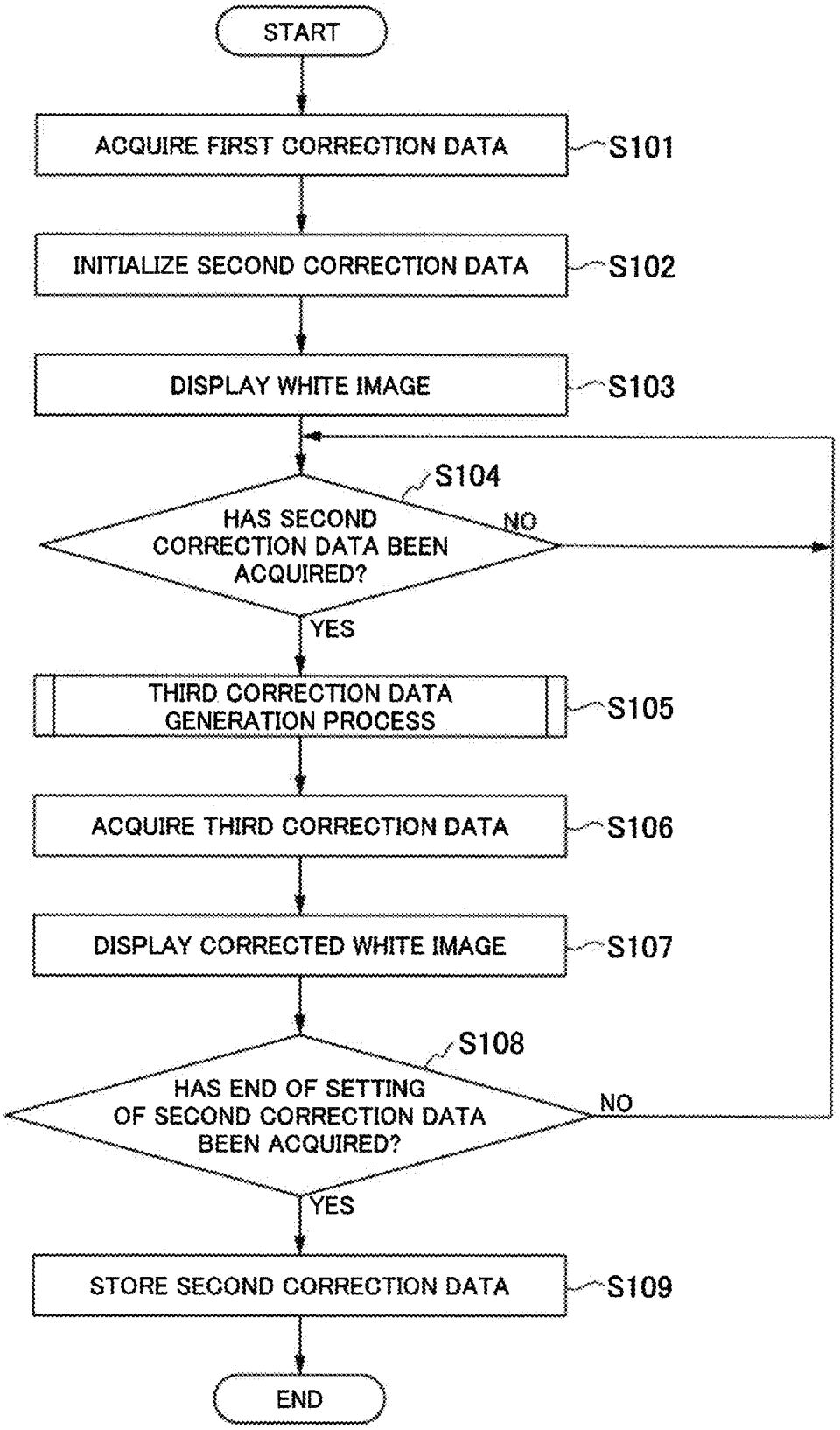
FIG. 7 is a flowchart showing an example of the operation performed by the image display apparatus 1 in accordance with the first example embodiment.

FIG. 7 is a flowchart showing an example of the operation performed by the image display apparatus 1 in accordance with the first example embodiment.

First, the correction data generation unit 100 acquires first correction data (step S101). The correction data generation unit 100 initializes second correction data stored in a storage unit (not shown in the drawings) (step S102). Accordingly, the correction data generation unit 100 outputs third correction data that indicates the same correction values as those of the first correction data to the display unevenness correction unit 30.

On the other hand, a white image is displayed in the liquid crystal panel 40 (step S103). The white image displayed in the liquid crystal panel 40 is an image based on an image signal that has been subjected to adjustment of the white balance by the white balance adjustment unit 20 and correction using the first correction data by the display unevenness correction unit 30. The white image is displayed by, for example, inputting an image signal of which color is white in which the values of the RGB are the same, that is, (255, 255, 255), from an external device to the image input unit 10.

Next, the correction data generation unit 100 determines whether or not second correction data set by, for example, a user who visually perceived the white image displayed in the liquid crystal panel 40 has been acquired (step S104). When the correction data generation unit 100 acquires the second correction data, the correction data generation unit 100 performs a third correction data generation process that generates third correction data (step S105).

The display unevenness correction unit 30 acquires the third correction data generated on the basis of the first correction data and the second correction data from the correction data generation unit 100 (step S106). The display unevenness correction unit 30 corrects the image signal using the acquired third correction data and outputs the corrected image signal to the liquid crystal panel 40. The liquid crystal panel 40 displays an image based on the image signal corrected by the display unevenness correction unit 30 (step S107).

The correction data generation unit 100 determines whether or not information indicating that the user, for example, visually perceived the corrected image and determined that display unevenness was resolved has been acquired (step S108). The information indicating the determination that the display unevenness was resolved is input to the correction data generation unit 100 by, for example, the user who clicks a button image (not shown in the drawings) indicating completion of the correction of FIG. 5(*b*).

If the correction data generation unit 100 has acquired the information indicating the determination that the display unevenness was resolved, the correction data generation unit 100 stores the second correction data in a storage unit (not shown in the drawings) (step S109).

In contrast, in step S108, if the correction data generation unit 100 has not acquired the information indicating the determination that the display unevenness was resolved, the correction data generation unit 100 returns the processing to step S104 and waits until second correction data set by, for example, the user is acquired.

Figure 8:
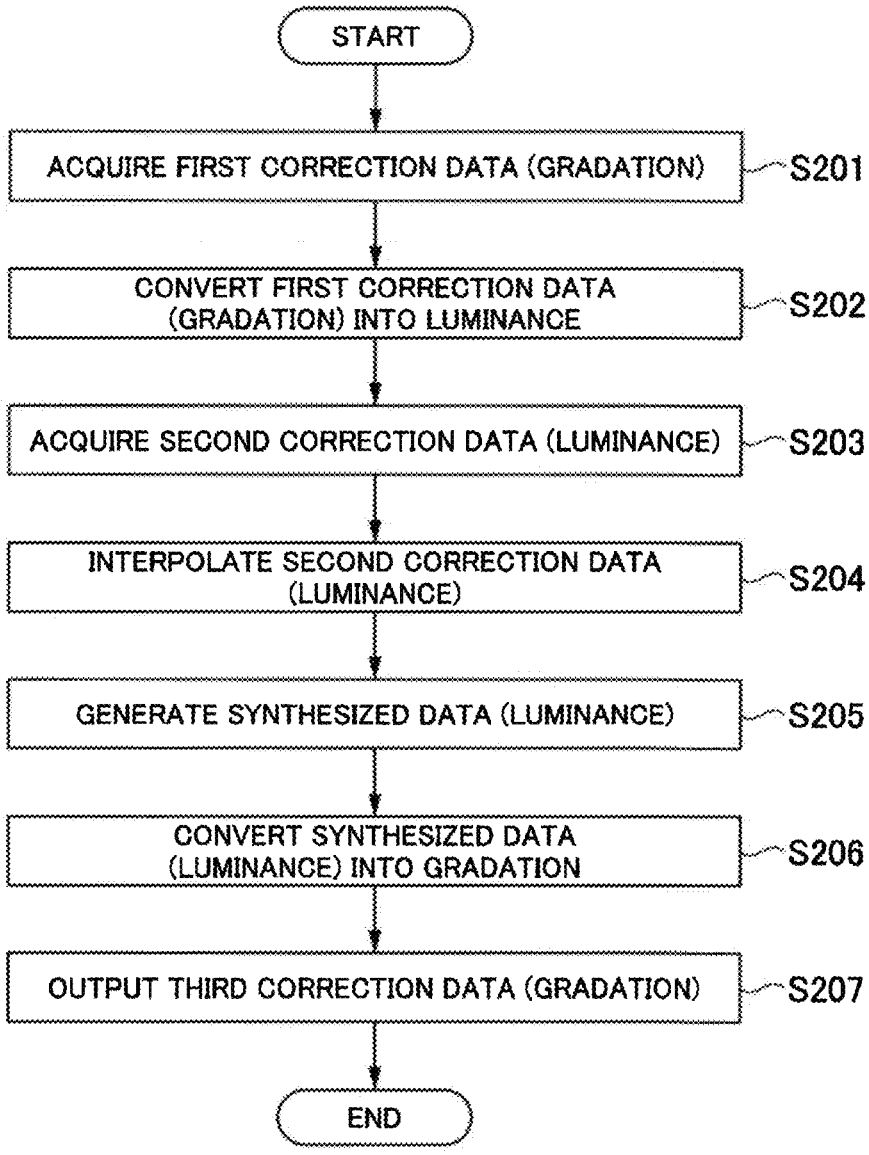
FIG. 8 is a flowchart showing an example of the operation performed by the correction data generation unit 100 in accordance with the first example embodiment.

FIG. 8 is a flowchart showing an example of the operation of the third correction data generation process performed by the correction data generation unit 100 in accordance with the first example embodiment.

First, the correction data generation unit 100 acquires first correction data (step S201). The first correction data acquired by the correction data generation unit 100 is data in which correction values are represented as gradations.

Next, the gradation/luminance conversion unit 110 of the correction data generation unit 100 converts the first correction data, in which the correction values are represented as gradations, into data in which correction values are represented as luminance using gradation/luminance data (step S202).

Next, the correction data generation unit 100 acquires second correction data (step S203). The second correction data acquired by the correction data generation unit 100 is data in which correction values are represented as luminance.

Next, the data interpolation unit 140 of the correction data generation unit 100 linearly interpolates the second correction data, in which the correction values are represented as luminance, to derive correction values that correspond to correction points of the first correction data (step S204).

Next, the synthesis unit 120 of the correction data generation unit 100 generates data obtained by synthesizing the first interpolation data, in which the correction values are represented as luminance, and the second correction data, in which the correction values that are represented as luminance and that correspond to the correction points of the first correction data are interpolated (step S205). The data generated by the synthesis unit 120 is data in which correction values are represented as luminance.

Next, the luminance/gradation conversion unit 130 of the correction data generation unit 100 converts the data in which the correction values are represented as luminance that has been generated by the synthesis unit 120 into data in which correction values are represented as gradations (step S206).

The luminance/gradation conversion unit 130 then outputs the converted data to the display unevenness correction unit 30 as third correction data (step S207).

As described above, the image display apparatus 1 in accordance with the first example embodiment is provided with the correction data generation unit 100, which generates third correction data that is used for correcting display unevenness of the image display apparatus 1 on the basis of first correction data that is used for correcting display unevenness resulting from the image display apparatus 1 itself and second correction data that is used for correcting display unevenness resulting from the environment set for the image display apparatus 1, and the display unevenness correction unit 30, which corrects an image signal using the third correction data.

Accordingly, the image display apparatus 1 in accordance with the first example embodiment can generate the third correction data based on the first correction data and the second correction data and correct the display unevenness using the third correction data, and thus the image display apparatus 1 in accordance with the first example embodiment can correct not only the display unevenness resulting from the apparatus but also the display unevenness resulting from an environment. Moreover, special facilities, such as a dark room and a high-performance camera, are not required in the course of generating the second correction data, and thus it is possible to easily generate the second correction data in a normal environment in which a user uses the image display apparatus and perform correction that is in conformity with an actually used environment. Moreover, the correction is performing using the second correction data in combination with the first correction data, which can be fine adjustment data, such as correction data at the time of shipping from a factory, and thus the overall image quality of the entire image is not deteriorated.

Moreover, in the image display apparatus 1 in accordance with the first example embodiment, the first correction data is data that includes correction values used for correcting pixels that correspond to a plurality of first correction points (e.g., a total of 800 correction points H in which 40 correction points are arranged in the horizontal direction of an image and 20 correction points are arranged in the vertical direction of the image as shown in FIG. 4) in the image based on the image signal. The second correction data is data that includes correction values used for correcting pixels that correspond to second correction points (e.g., a total of four correction points that are respectively arranged in regions obtained by dividing the image into four as shown in FIG. 5(*b*)) in the image based on the image signal, and the number of the second correction points is smaller than the number of the first correction points. The correction data generation unit 100 is further provided with the data interpolation unit 140, which derives the second correction data for correction points that correspond to the same positions as the first correction points by interpolating correction values corresponding to the second correction points.

Accordingly, in addition to the above-described example advantages, the image display apparatus 1 in accordance with the first example embodiment can alleviate the burden on, for example, a user who performs a setting because the number of the correction points in the second correction data is smaller than the number of the correction points in the first correction data. This is because in general, a user visually perceives display unevenness resulting from an environment and thus it is conceivable that the second correction data is set by the user in many cases. Moreover, display unevenness resulting from an environment is not unevenness such as small bumps and dips generated in a display image. Rather, it has so-called low frequency characteristics, such as a slope in which color varies gradually and distortion, and thus it is possible to correct display unevenness resulting from an environment even if the number of the correction points is small.

Moreover, in the image display apparatus 1 in accordance with the first example embodiment, the first correction data is data in which correction values are represented as gradations, the second correction data is data in which correction values are represented as luminance, and the correction data generation unit 100 is provided with the gradation/luminance conversion unit 110, which converts the first correction data into data in which correction values are represented as luminance, the synthesis unit 120, which synthesizes the first correction data converted by the gradation/luminance conversion unit 110 and the second correction data, and the luminance/gradation conversion unit 130, which converts data synthesized by the synthesis unit 120 into data in which correction values are represented as gradations.

Accordingly, the image display apparatus 1 in accordance with the first example embodiment can correct an image signal using the data in which the correction values are represented as gradations, and thus the image display apparatus 1 in accordance with the first example embodiment can perform correction using the same correction technique as that widely used in common image display apparatuses. On the other hand, because display unevenness caused by an environment is visually perceived and recognized by a user, it is preferable that the correction values be set while a display image is displayed. That is, when the correction values of the second correction data are represented as luminance, the correction values can be intuitive and more plausible. Moreover, although a white image (i.e., an image having a higher gradation) is displayed and the second correction data is generated, conversion between gradation and luminance are performed twice by the gradation/luminance conversion unit 110 and the luminance/gradation conversion unit 130, and thus it is unlikely that display unevenness resulting from correction using correction data for a different layer is generated.

Moreover, in the image display apparatus 1 in accordance with the first example embodiment, the first correction data is data that is used for correcting display unevenness generated when a white balance setting is invalidated, and the second correction data is data that is used for correcting display unevenness generated when the white balance setting is validated and correction using the first correction data has been performed.

Accordingly, by using the second correction data, the image display apparatus 1 in accordance with the first example embodiment can correct display unevenness generated when the white balance setting is validated despite the correction using the first correction data is performed.

Figure 9:
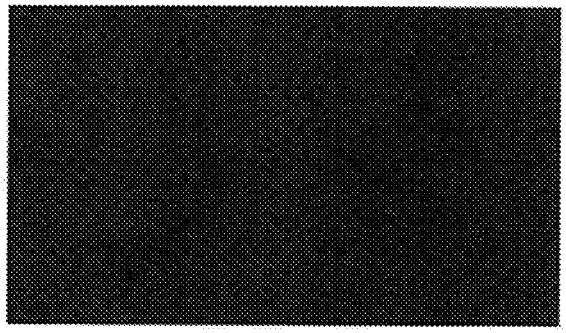
FIG. 9 is a diagram describing an example advantage of the first example embodiment.
Figure 9:
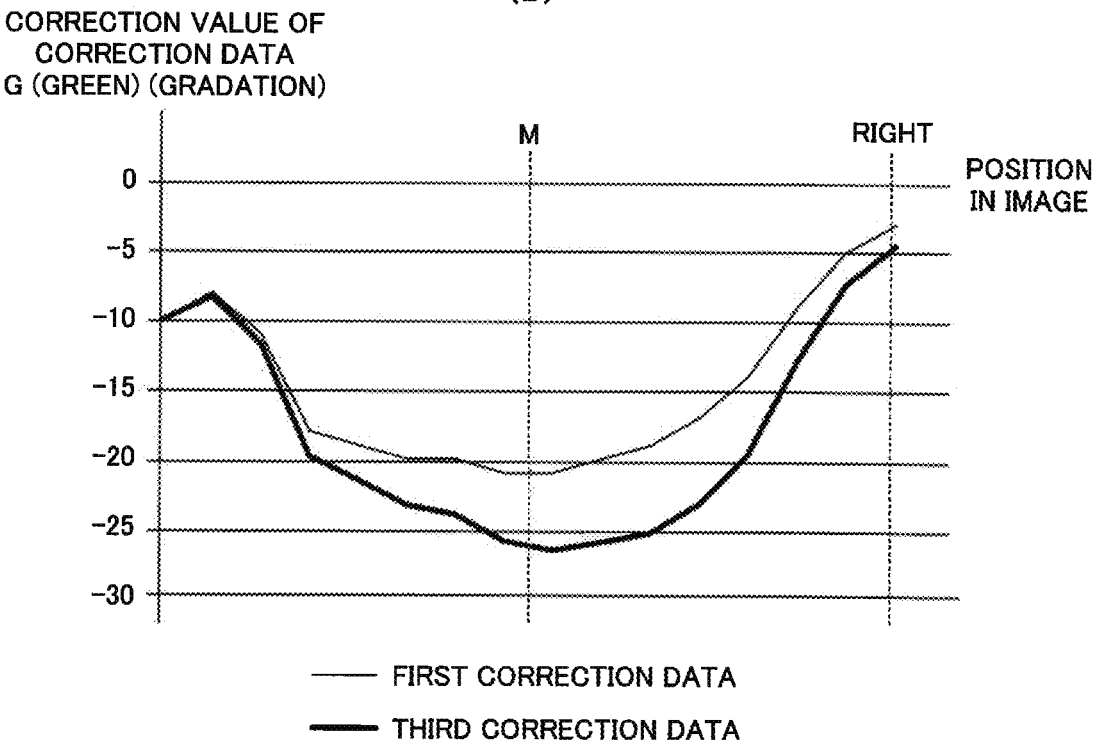

FIG. 9 is a diagram describing an example advantage of the first example embodiment. FIG. 9(*a*) is a diagram showing an example of an image that is obtained by correcting the image of FIG. 5(*a*) using the third correction data. FIG. 9(*b*) is a diagram showing the relationship between the first correction data and the third correction data with respect to the position in an image. In FIG. 9(*b*), the horizontal axis represents a position in the image and the vertical axis represents a correction value for G (green) in the correction data. Moreover, "0" in the horizontal axis represents the position of the upper left edge of the image, "M" in the horizontal axis represents the position of the upper center of the image, and "R" represents the position of the upper right edge of the image. Moreover, the vertical axis represents correction data represented as an offset value from a gradation of 255, "0" represents a gradation of 255, "−10" represents a gradation of 245, and "−30" represents a gradation of 225.

As shown in FIG. 9(*a*), it can be confirmed that the hue of green strongly displayed in the upper right portion slightly separated from the central portion of an image in the image display apparatus 1 shown in FIG. 5(*a*) is corrected and display unevenness is corrected over the entirety of a screen.

As shown in FIG. 9(*b*), while the correction value of the third correction data corresponding to the upper left edge of the screen is not changed from that of the first correction data, the correction values of the third correction data from the upper left to upper right of the screen are changed from those of the first correction data. Because the correction value of the first correction data at the upper center of the screen is large, the difference between the first correction data and the third correction data at the upper center of the screen is large; however, the rate of the amount of change in luminance from the first correction data to the third correction data has the largest value at the upper right edge of the screen.

Modified Example 1 of First Example Embodiment

Next, a modified example 1 of the first example embodiment will be described. The present modified example differs from the above-described first example embodiment in that an image signal is input by a test signal generation unit (not shown in the drawings) of the image display apparatus 1 when an image is displayed in the liquid crystal panel 40 in the process shown by step S103 of FIG. 7.

The test signal generation unit outputs an image signal used for generating the second correction data to the image input unit 10 on the basis of control by the correction data generation unit 100 or a display control unit (not shown in the drawings) of the image display apparatus 1.

Because the image signal used for generating the second correction data is output from the test signal generation unit, an external device that inputs an image signal to the image display apparatus 1 when the second correction data is generated is not required.

Modified Example 2 of First Example Embodiment

Next, a modified example 2 of the first example embodiment will be described. The present modified example differs from the above-described first example embodiment in that the number of the correction points of the second correction data is greater than 4 or less than 4.

When the number of the correction points included in the second correction data is greater than 4, an image is divided into five or more regions. In addition, a correction point is provided in each of the regions. As the image G-7 used in the operation shown in, for example, FIG. 5(*b*), an image used for setting correction values for five or more correction points is displayed.

When the number of the correction points of the second correction data is less than 4, an image is divided into three or less regions. In addition, a correction point is provided in each of the region. As the image G-7 used in the operation shown in, for example, FIG. 5(*b*), an image used for setting correction values for three or less correction points is displayed.

Modified Example 3 of First Example Embodiment

Next, a modified example 3 of the first example embodiment will be described. The present modified example differs from the above-described first example embodiment in that a unit used for correcting display unevenness is a system of units that is different from the RGB values.

In the present modified example, for example, first correction data in which correction values are represented in accordance with CIE 1931, which is a chromaticity diagram stipulated by the CIE (International Commission on Illumination), is input to the correction data generation unit 100. Moreover, for example, chromaticity diagram/RGB data (e.g., see https://en.wikipedia.org/wiki/SRGB), which indicates the correspondence relationship between CIE 1931 and RGB, is input to the correction data generation unit 100. With respect to the acquired first correction data, the correction data generation unit 100, for example, converts CIE 1931 into RGB and further converts RGB into luminance. Moreover, with respect to data obtained by synthesizing first correction data that has been converted into luminance and second correction data, the correction data generation unit 100, for example, converts luminance into RGB and further converts RGB into CIE 1931 to thereby generate third correction data.

It is to be noted that in the present modified example, it is sufficient that a unit used for correction using correction data is a system of units that is different from the RGB values, and thus it is not limited to CIE 1931. For example, first correction data in which correction values are represented in accordance with the Lab color space may be input to the correction data generation unit 100.

Modified Example 4 of First Example Embodiment

Next, a modified example 4 of the first example embodiment will be described. The present modified example differs from the above-described first example embodiment in that the presence or absence of display unevenness is determined using a color sensor, instead of a visual inspection by, for example, a user when the second correction data is generated.

The color sensor is a measuring instrument that measures color information. The color sensor is provided with, for example, a detector that detects the intensity (luminance) of light beams radiated in a specific direction for each wavelength. For example, the color sensor has a pencil shape and detects color information of an object by bringing its tip into contact with a display screen through an operation of, for example, a user.

In the present modified example, color information of correction points and regions in which there is no display unevenness is acquired by, for example, a user who operates the color sensor in the process shown in step S108 of FIG. 7, and if the difference between the respective pieces of color information is smaller than or equal to a predetermined threshold, information indicating that display unevenness has been resolved is input to the correction data generation unit 100.

Second Example Embodiment

Next, a second example embodiment will be described.

Figure 10:
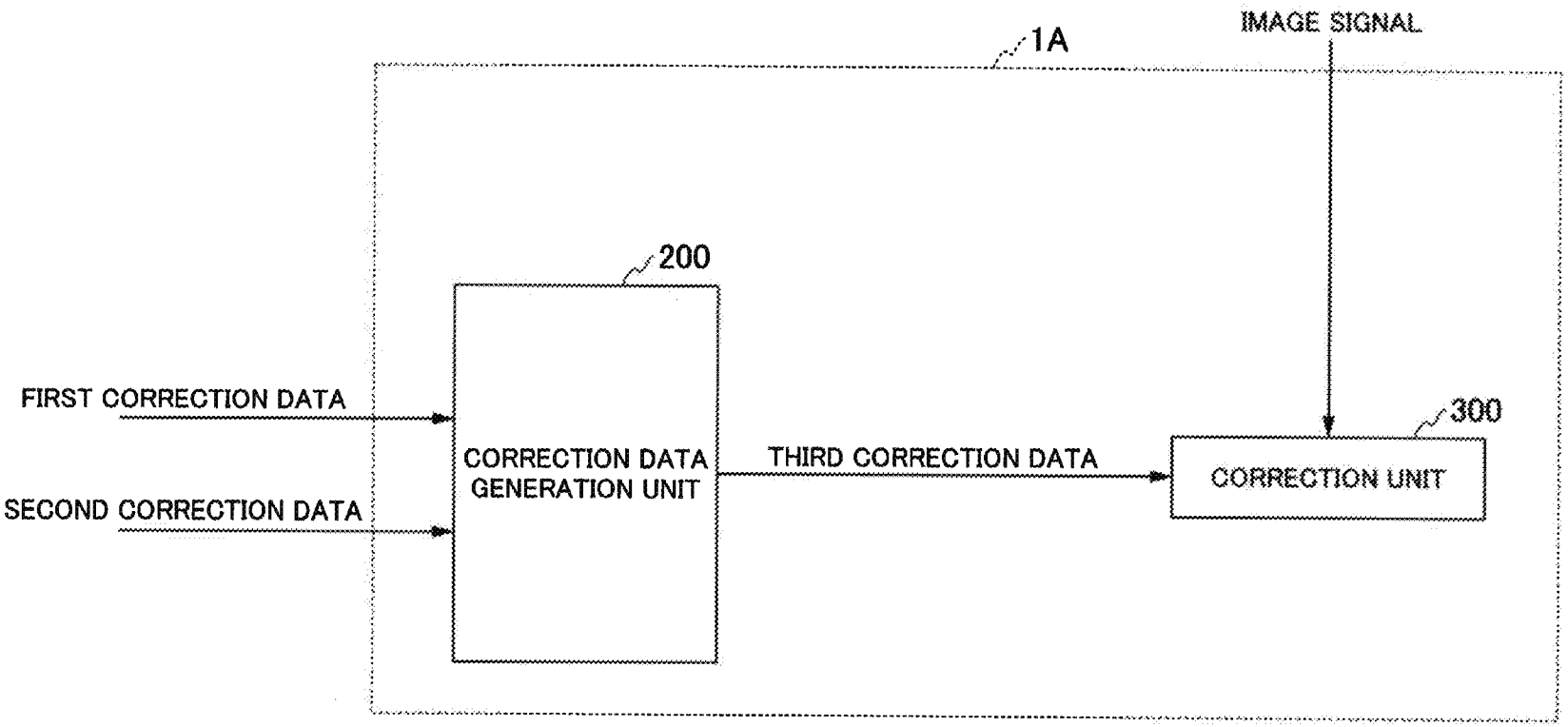
FIG. 10 is a block diagram showing an example of the structure of an image display apparatus 1 in accordance with a second example embodiment.

FIG. 10 is a block diagram showing an example of the structure of an image display apparatus 1A in accordance with a second example embodiment. As shown in FIG. 10, the image display apparatus 1A is provided with a correction data generation unit 200 and a correction unit 300. The correction data generation unit 200 generates third correction data that is used for correcting display unevenness of the image display apparatus 1A on the basis of first correction data that is used for correcting display unevenness resulting from the image display apparatus 1A itself and second correction data that is used for correcting display unevenness resulting from the environment set for the image display apparatus 1A. The correction unit 300 corrects an image signal using the third correction data.

It is to be noted that the process of suppressing display unevenness may be controlled by recording a program for achieving all or some of the functions of the image display apparatus 1 and the correction data generation unit 100 in the present invention on a computer-readable recording medium and causing a computer system to read and execute the program recorded on this recording medium. It is to be noted that the "computer system" mentioned here includes an OS and hardware such as peripheral devices. Moreover, the "computer system" also includes a WWW system that is provided with a web page providing environment (or a display environment). Furthermore, "computer-readable recording medium" refers to portable media, such as a flexible disk, a magneto-optical disc, a ROM, and a CD-ROM, and a storage apparatus, such as a hard disk built in a computer system. Additionally, "computer-readable recording medium" also includes a recording medium that holds a program for a given time, such as a volatile memory (RAM) inside a computer system that functions as a server or a client when the program is transmitted via a network, such as the Internet, and/or a communication circuit, such as a telephone circuit.

Moreover, the program may be communicated from a computer system that stores the program in, for example, a storage apparatus to another computer system via transmission media or transmission waves in transmission media. Here, the "transmission media" that communicate the program refer to media having a function of communicating information, such as as a network (a communication network) like the Internet and a communication circuit (a communication line) such as a telephone circuit. Moreover, the program may achieve some of the above-described functions. Furthermore, the program may be a so-called differential file (a differential program) that achieves the above-described functions in combination with a program that is already recorded in a computer system.

The example embodiments of the present invention have been described above in detail with reference to the drawings, but the specific structure is not limited to the example embodiments, and the present invention includes design and the like that do not depart from the gist of the present invention.

INDUSTRIAL APPLICABILITY

The above-described image display system can be applied to displays that use liquid crystal for which not only correction of display unevenness resulting from image display apparatuses is demanded but also correction of display unevenness resulting from environments is demanded. In particular, the above-described image display system is suitable to applications that require exact color reproduction, such as graphic design, applications for printing shops, and applications for image diagnosis in medical care.

DESCRIPTION OF REFERENCE SIGNS

1, 1A . . . image display apparatus
30 . . . display unevenness correction unit
100, 200 . . . correction data generation unit
110 . . . gradation/luminance conversion unit
120 . . . synthesis unit
130 . . . luminance/gradation conversion unit
140 . . . data interpolation unit
300 . . . correction unit

The invention claimed is:

1. An image display apparatus, comprising:

a correction data generator that generates third correction data that is used for correcting display unevenness of the image display apparatus on a basis of first correction data that is used for correcting display unevenness resulting from the image display apparatus itself and second correction data that is used for correcting display unevenness resulting from an environment set for the image display apparatus; and a corrector that corrects an image signal using the third correction data, wherein the first correction data comprises data that comprises correction values used for correcting pixels that correspond to a plurality of first correction points in an image based on the image signal, wherein the second correction data comprises data that comprises correction values used for correcting pixels that correspond to second correction points in the image based on the image signal, a number of the second correction points being smaller than a number of the first correction points, and wherein the correction data generator comprises a data interpolator that derives the second correction data for correction points that correspond to same positions as the first correction points by interpolating correction values that correspond to the second correction points.

2. The image display apparatus according to claim 1, wherein the first correction data comprises data in which correction values are represented as gradations, wherein the second correction data comprises data in which correction values are represented as luminance, and wherein the correction data generator further comprises:

a first converter that converts the first correction data into data in which correction values are represented as luminance;

a synthesizer that synthesizes the first correction data converted by the first converter and the second correction data; and a second converter that converts data synthesized by the synthesizer into data in which correction values are represented as gradations.

3. The image display apparatus according to claim 1, wherein the first correction data comprises data that is used for correcting display unevenness while a white balance setting is invalidated, and wherein the second correction data comprises data used for correcting display unevenness while the white balance setting is validated and correction using the first correction data has been performed.

4. An image display method, comprising:

generating third correction data that is used for correcting display unevenness of an image display apparatus on a basis of first correction data that is used for correcting display unevenness resulting from the image display apparatus itself and second correction data that is used for correcting display unevenness resulting from an environment set for the image display apparatus; and correcting an image signal using the third correction data, wherein the first correction data comprises data that comprises correction values used for correcting pixels that correspond to a plurality of first correction points in an image based on the image signal, wherein the second correction data comprises data that comprises correction values used for correcting pixels that correspond to second correction points in the image based on the image signal, a number of the second correction points being smaller than a number of the first correction points, and wherein the generating the third correction data comprises deriving the second correction data for correction points that correspond to same positions as the first correction points by interpolating correction values that correspond to the second correction points.

5. The image display method according to claim 4, wherein the first correction data comprises data in which correction values are represented as gradations, wherein the second correction data comprises data in which correction values are represented as luminance, and wherein the generating the third correction data further comprises:

converting the first correction data into data in which correction values are represented as luminance;

synthesizing the first correction data converted and the second correction data; and converting synthesized data into data in which correction values are represented as gradations.

6. The image display method according to claim 4, wherein the first correction data comprises data that is used for correcting display unevenness while a white balance setting is invalidated, and wherein the second correction data comprises data used for correcting display unevenness while the white balance setting is validated and correction using the first correction data has been performed.

7. An image display apparatus, comprising:

a processor; and memory coupled with the processor, the memory storing instructions, when executed by the processor, causing the image display apparatus to at least:

generate third correction data that is used for correcting display unevenness of an image display apparatus on a basis of first correction data that is used for correcting display unevenness resulting from the image display apparatus itself and second correction data that is used for correcting display unevenness resulting from an environment set for the image display apparatus; and correct an image signal using the third correction data, wherein the first correction data comprises data that comprises correction values used for correcting pixels that correspond to a plurality of first correction points in an image based on the image signal, wherein the second correction data comprises data that comprises correction values used for correcting pixels that correspond to second correction points in the image based on the image signal, a number of the second correction points being smaller than a number of the first correction points, and wherein the instructions further causes the image display apparatus to derive the second correction data for correction points that correspond to same positions as the first correction points by interpolating correction values that correspond to the second correction points.

8. The image display apparatus according to claim 7, wherein the first correction data comprises data in which correction values are represented as gradations, wherein the second correction data comprises data in which correction values are represented as luminance, and wherein the instructions further causes the image display apparatus to:

convert the first correction data into data in which correction values are represented as luminance;

synthesize the first correction data converted and the second correction data; and convert synthesized data into data in which correction values are represented as gradations.

9. The image display apparatus according to claim 7, wherein the first correction data comprises data that is used for correcting display unevenness while a white balance setting is invalidated, and wherein the second correction data comprises data used for correcting display unevenness while the white balance setting is validated and correction using the first correction data has been performed.

* * * * *